US011389927B2

(12) United States Patent
Fukushi et al.

(10) Patent No.: US 11,389,927 B2
(45) Date of Patent: Jul. 19, 2022

(54) PROCESSING APPARATUS

(71) Applicant: DISCO CORPORATION, Tokyo (JP)

(72) Inventors: Nobuyuki Fukushi, Tokyo (JP); Souichi Matsubara, Tokyo (JP); Suzu Hoshino, Tokyo (JP); Hidekazu Nakayama, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 573 days.

(21) Appl. No.: 16/402,354

(22) Filed: May 3, 2019

(65) Prior Publication Data

US 2019/0351525 A1 Nov. 21, 2019

(30) Foreign Application Priority Data

May 18, 2018 (JP) ..... JP2018-096039

(51) Int. Cl.
*B24B 49/00* (2012.01)
*B24B 7/22* (2006.01)

(52) U.S. Cl.
CPC ..... *B24B 49/00* (2013.01); *B24B 7/228* (2013.01)

(58) Field of Classification Search
CPC ..... B24B 49/00; B24B 7/228
USPC ..... 451/8, 5, 41
See application file for complete search history.

(56) References Cited

U.S. PATENT DOCUMENTS

2006/0286903 A1* 12/2006 Tanaka ..... B24B 49/00 451/5
2011/0088921 A1* 4/2011 Forgues ..... B25F 5/001 173/1
2017/0236267 A1* 8/2017 Negishi ..... G06K 9/6201 348/87
2018/0102268 A1* 4/2018 Sekiya ..... H01L 22/20
2018/0218931 A1* 8/2018 Odaira ..... H01L 21/67161

FOREIGN PATENT DOCUMENTS

JP 2014161948 A 9/2014

* cited by examiner

*Primary Examiner* — Joseph J Hail
*Assistant Examiner* — Shantese L McDonald
(74) *Attorney, Agent, or Firm* — Greer Burns & Crain, Ltd.

(57) ABSTRACT

A processing apparatus includes a first distinguishing display unit which, when a mechanism making a holding force or a processing force act on a workpiece causes an error, displays a workpiece illustration representing the workpiece to which the error is caused and on which the holding force or the processing force acts distinguishably from another workpiece illustration. The workpiece on which the holding force or the processing force of the mechanism causing the error acts can be thereby identified easily.

14 Claims, 6 Drawing Sheets

PROCESSING APPARATUS

BACKGROUND OF THE INVENTION

Field of the Invention

The present invention relates to a processing apparatus that processes a wafer.

Description of the Related Art

A processing apparatus that processes a wafer, the processing apparatus being, for example, as a cutting apparatus, a grinding apparatus, or the like, includes: a cassette stage on which a cassette housing wafers in the form of shelves is mounted; temporary placing means temporarily placing a wafer extracted from the cassette; a chuck table that holds a wafer to be processed; loading means loading the wafer from the temporary placing means onto the chuck table; processing means processing the wafer held by the chuck table, the processing means having a processing tool fitted thereto; cleaning means cleaning the wafer after being processed; unloading means unloading the wafer from the chuck table onto the cleaning means; robot conveying means extracting a wafer from the cassette and housing a wafer into the cassette; a touch panel used to input and display various kinds of processing information; and the like (see, for example, Japanese Patent Laid-Open No. 2014-161948).

The touch panel has an input function for setting and inputting processing conditions and a display function of displaying the operation state of the processing apparatus. The display function of the touch panel is a function of displaying an arrangement plan depicting an arrangement of each means such as the cassette stage, the temporary placing means, the chuck table, the loading means, the processing means, the cleaning means, the unloading means, the robot conveying means, and the like when the processing apparatus is viewed from above. In addition, in a case where the processing apparatus is operated fully automatically, each of wafers moving within the apparatus is also displayed on the arrangement plan.

In addition, when an error is caused during fully automatic operation, an error message is displayed in a message display section on an upper portion of the touch panel, for example. For example, an error message is displayed in the message display section when a suction pressure error occurs because the suction pressure of the chuck table sucking and holding a wafer does not reach a pressure set in advance during processing, or when a load current value error occurs because the load current value of a spindle unit that rotates the processing tool (grindstone) of grinding means becomes equal to or more than a value set in advance during processing. Then, an operator grasps conditions of occurrence of the error by reading the error message displayed in the message display section.

SUMMARY OF THE INVENTION

However, it is not possible to precisely grasp, from the error message, information of which wafer is the wafer to which the error is caused or where the processing apparatus causes the error. Thus, it is not possible to identify the wafer as a defective product, and it is difficult to determine the cause of the error.

In addition, even when an error occurs, in a case where the error is a minor error, the apparatus continues operating fully automatically. Thus, the wafer to which the error is caused among wafers housed in the cassette after being processed is not identified.

It is accordingly an object of the present invention to provide a processing apparatus that makes it possible to easily grasp a wafer to which an error is caused and an error location within the apparatus.

In accordance with an aspect of the present invention, there is provided a processing apparatus including: a chuck table configured to hold a workpiece; processing means configured to process the workpiece held by the chuck table, a processing tool being fitted to the processing means; conveying means configured to convey the workpiece; a touch panel having an input function of inputting a processing condition and a display function of displaying a state of the processing apparatus; and first distinguishing display means, when means making a holding force or a processing force act on the workpiece causes an error, configured to display a workpiece illustration representing the workpiece to which the error is caused and on which the holding force or the processing force acts distinguishably from another workpiece illustration; the display function of the touch panel being a function of displaying an arrangement plan depicting an arrangement of means when the processing apparatus is viewed from above and workpiece illustrations representing workpieces held by the respective means.

Preferably, the processing apparatus further includes second distinguishing display means configured to display a workpiece illustration representing a workpiece that is held on the chuck table and completes being normally processed by the processing means distinguishably from the workpiece illustration representing the workpiece to which the error is caused.

Preferably, the processing apparatus further includes: a cassette stage on which a cassette housing workpieces in a form of shelves is mounted; and control means configured to display the cassette in the form of the shelves in an enlarged state and distinguishably display workpiece illustrations representing the workpieces housed in the cassette by the first distinguishing display means and the second distinguishing display means when a cassette stage illustration representing the cassette stage is touched on the arrangement plan of the touch panel.

Preferably, the processing apparatus further includes third distinguishing display means configured to display a workpiece illustration representing a workpiece before being processed by the processing means distinguishably from a workpiece illustration representing a workpiece after being processed, in which the workpiece illustration representing the workpiece before being processed among the workpieces housed in the cassette is distinguishably displayed by the third distinguishing display means so as to be distinguished from the workpiece after being processed when the cassette stage illustration representing the cassette stage is touched on the arrangement plan of the touch panel.

Preferably, the processing apparatus further includes fourth distinguishing display means configured to display a means illustration representing the means causing the error distinguishably from another means illustration on the arrangement plan when the means making the holding force or the processing force act on the workpiece causes the error.

In the present invention, the first distinguishing display means is provided which, when means making a holding force or a processing force act on a workpiece causes an error, displays a workpiece illustration representing the workpiece to which the error is caused and on which the holding force or the processing force acts distinguishably from another workpiece illustration. It is therefore possible to easily identify the workpiece on which the holding force or the processing force of the means causing the error acts.

In addition, the second distinguishing display means is provided which displays a workpiece illustration representing a workpiece that completes being processed normally distinguishably from the workpiece illustration representing the workpiece to which the error is caused. Thus, the workpiece to which the error is caused and the workpiece to which no error is caused can be distinguished from each other easily.

When a cassette stage illustration representing the cassette stage is touched on the arrangement plan of the touch panel, the cassette is displayed in the form of shelves in an enlarged state, and workpiece illustrations representing the workpieces housed in the cassette are displayed distinguishably by the first distinguishing display means and the second distinguishing display means. Thus, the workpiece to which the error is caused and the workpiece to which no error is caused among the workpieces housed within the cassette after processing can also be distinguished from each other easily.

The third distinguishing display means is provided, and workpiece illustrations representing workpieces before being processed among the workpieces housed in the cassette are displayed distinguishably from workpiece illustrations representing workpieces after being processed when the cassette stage illustration is touched on the arrangement plan. Then, the number of processed workpieces and the number of workpieces before being processed can be grasped easily.

The fourth distinguishing display means is provided which displays a means illustration representing the means causing the error distinguishably from another means illustration on the arrangement plan. It is thereby possible to grasp the means causing the error easily.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
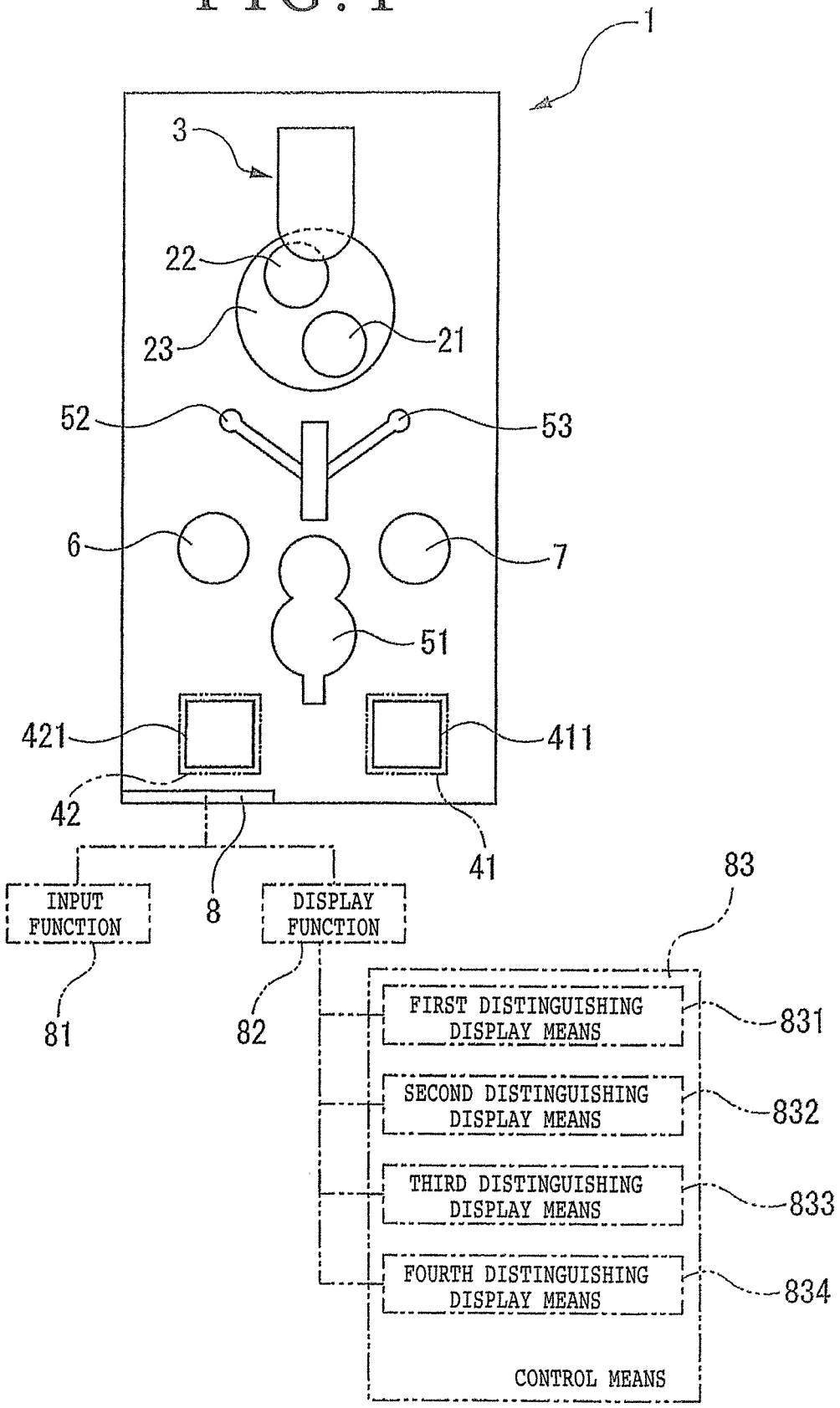
FIG. 1 is a plan view depicting a configuration of a grinding apparatus.

A grinding apparatus 1 depicted in FIG. 1 is an example of a processing apparatus. The grinding apparatus 1 is an apparatus that processes workpieces held on chuck tables 21 and 22 by processing means 3. The chuck tables 21 and 22 are revolvably and rotatably supported by a turn table 23.

As depicted in FIG. 1, the grinding apparatus 1 is constituted of: a cassette stage 41 on which a loading cassette 411 housing workpieces before being processed is mounted and a cassette stage 42 on which an unloading cassette 421 housing workpieces after being processed is mounted; a carrying in/out robot 51 as conveying means carrying out a workpiece from the loading cassette 411 and carrying a workpiece into the unloading cassette 421; temporary placing means 6 that is disposed in a movable range of the carrying in/out robot 51 and on which a workpiece carried out from the loading cassette 411 is mounted and positioned in a fixed position; cleaning means 7 cleaning a workpiece after being processed, the cleaning means 7 being disposed in the movable range of the carrying in/out robot 51; loading means 52 as conveying means conveying a workpiece before being processed onto one of the chuck tables 21 and 22 from the temporary placing means 6; unloading means 53 as conveying means conveying a workpiece after being processed from one of the chuck tables 21 and 22 onto the cleaning means 7; and a touch panel 8 disposed in the front surface of the apparatus.

The touch panel 8 has an input function 81 of inputting processing conditions and a display function 82 of displaying the state of the grinding apparatus 1. The input function 81 is a function of displaying a processing condition input screen on the screen of the touch panel 8, and receiving the input of a processing condition when a predetermined position on the screen is touched. The display function 82 displays an arrangement plan depicting the arrangement of each means when the grinding apparatus 1 is viewed from above and workpiece illustrations representing workpieces held by respective means. Displayed on the arrangement plan are illustrations of the respective means, for example cassette stage illustrations representing the cassette stages 41 and 42, a processing means illustration representing the processing means 3, and the like.

The display function 82 performs display processing under control of control means 83. The control means 83 has first distinguishing display means 831 distinguishably displaying a workpiece illustration representing a workpiece on which a holding force or a processing force of means causing an error acts when the means making the holding force or the processing force act on the workpiece causes the error. That is, the workpiece being held or processed by the means causing the error is displayed so as to be distinguished from workpieces being held or processed by means causing no error.

The control means 83 has second distinguishing display means 832 displaying workpiece illustrations representing workpieces that are held on the chuck tables 21 and 22 and for which the processing means 3 has normally completed processing distinguishably from another workpiece illustration. That is, the workpieces whose processing is normally completed are displayed so as to be distinguished from the workpiece whose processing is not normally completed.

The control means 83 has third distinguishing display means 833 displaying workpiece illustrations representing workpieces before being processed by the processing means 3 distinguishably from workpieces in the middle of being processed and after being processed. That is, the workpieces before being processed are displayed so as to be distinguished from the workpieces in the middle of being processed and after being processed.

The control means 83 has fourth distinguishing display means 834 displaying a means illustration depicting means causing an error distinguishably from other means illustrations on the arrangement plan when the means making a holding force or a processing force act on a workpiece causes the error. That is, when means having a holding or processing function causes an error, the means is displayed so as to be distinguished from means causing no error.

Figure 2:
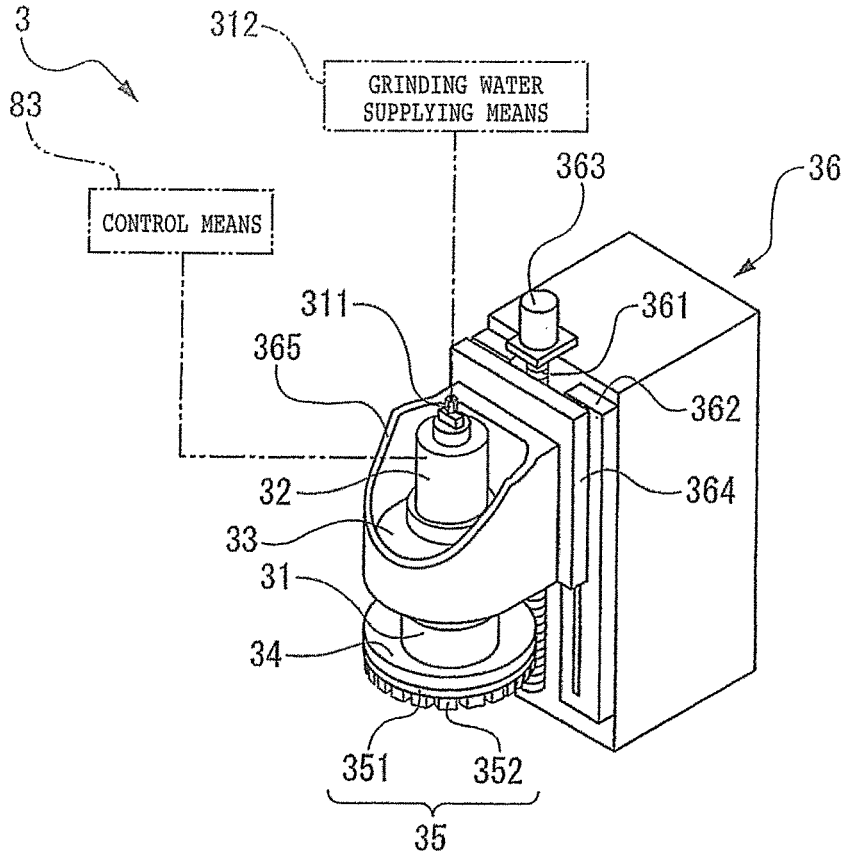
FIG. 2 is a perspective view depicting an example of processing means.

As depicted in FIG. 2, the processing means 3 is a grinding unit, and the processing means 3 includes: a rotatable spindle 31; a motor 32 that rotates the spindle 31; a housing 33 that rotatably supports the spindle 31; a mount 34 fitted to a lower end of the spindle 31; and a grinding wheel 35 fitted to the mount 34. The grinding wheel 35 is constituted of a base 351 fixed to the mount 34 and a grinding stone 352 as a processing tool annularly fixed to an undersurface of the base 351. In addition, a grinding water flow passage 311 through which grinding water is made to flow is formed in the spindle 31. Grinding water supplying means 312 is connected to the grinding water flow passage 311. The grinding water supplied from the grinding water supplying means 312 to the grinding water flow passage 311 is jetted downward from a lower portion of the grinding wheel 35.

The grinding water flow passage 311 is provided with a flow rate sensor that recognizes an amount of flowing grinding water. When the flow rate sensor recognizes a flow rate value lower than a set flow rate set in advance, the control means 83 recognizes this as an error in the grinding water supplying means 312. Incidentally, the arrangement plan does not include a flow rate sensor illustration. Thus, when the flow rate sensor detects the error, the fourth distinguishing display means 834 distinguishably displays an illustration of the processing means 3 as means causing the error. In addition, an illustration of a workpiece held on the chuck table 21 or the chuck table 22 when the error is caused is also distinguishably displayed as a workpiece to which the error is caused.

The processing means 3 can be raised and lowered by being driven by processing feed means 36. The processing feed means 36 includes: a ball screw 361 having an axis in a vertical direction (Z-direction); a pair of guide rails 362 arranged in parallel with the ball screw 361; a motor 363 that rotates the ball screw 361 in both of a normal direction and a reverse direction; a raising and lowering board 364 that internally has a nut screwed on the ball screw 361 and has side portions thereof in sliding contact with the guide rails 362; and a holder 365 that is fixed to the raising and lowering board 364 and holds the housing 33. When the ball screw 361 rotates by being driven by the motor 363, the raising and lowering board 364 is raised or lowered while guided by the guide rails 362, and the processing means 3 is raised or lowered accordingly.

The motor 32 provided to the processing means 3 is controlled by the control means 83 so as to rotate at a fixed rotational speed. When the grinding stone 352 comes into contact with a workpiece and grinding is performed, the load current of the motor 32 is increased in order to hold the rotational speed constant. In addition, when loading occurs in the grinding stone 352, for example, the load current of the motor 32 is further increased, which the control means 83 recognizes as an error.

Figure 3:
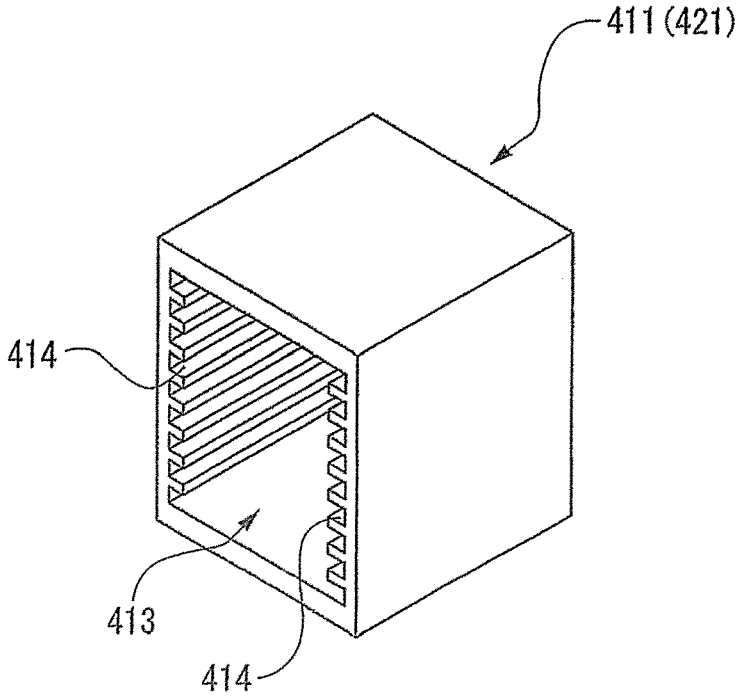
FIG. 3 is a perspective view depicting an example of a cassette.

Workpieces before being processed are housed in the loading cassette 411 depicted in FIG. 3, for example. The loading cassette 411 has an opening portion 413 formed on a front surface side and a plurality of grooves 414 arranged in the vertical direction on a left and a right inner surface. A left and a right groove 414 located at a same height constitute one slot. The workpieces are housed in the form of shelves in a plurality of slots. In addition, workpieces after being processed are housed in the unloading cassette 421 formed in a similar manner.

Figure 4:
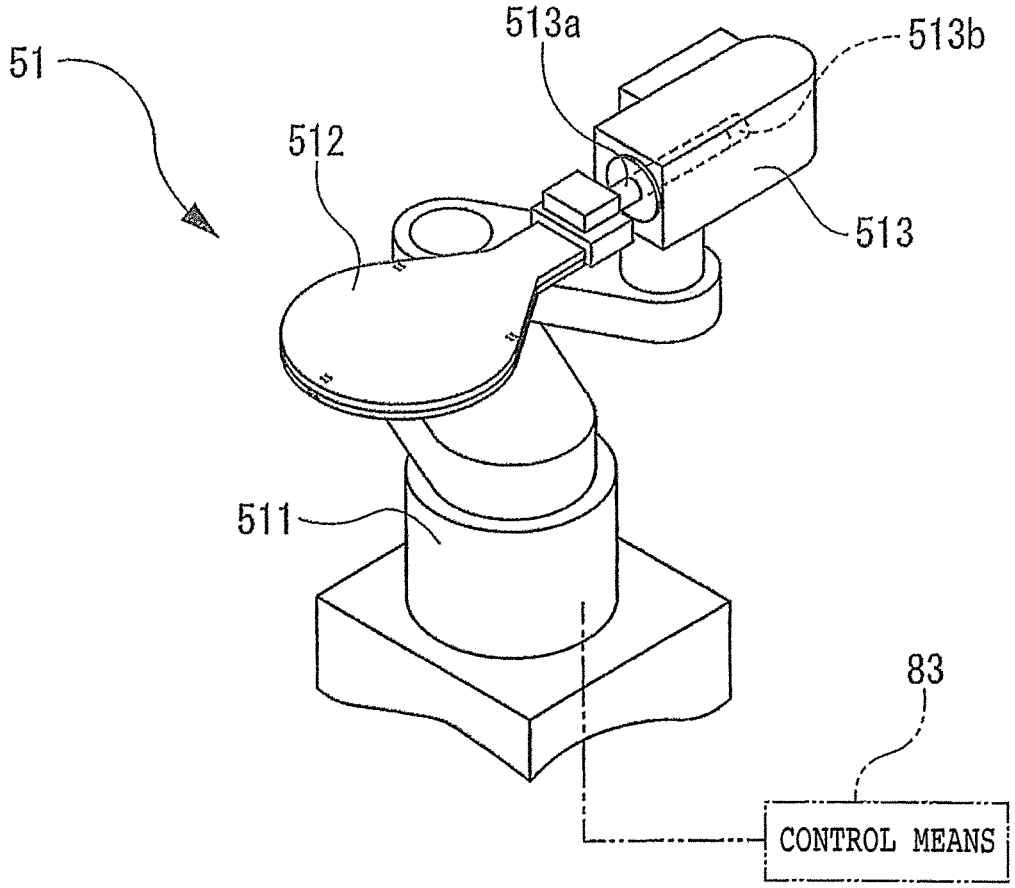
FIG. 4 is a perspective view depicting an example of a carrying in/out robot.

The workpieces housed in the form of shelves in the loading cassette 411 are carried out by the carrying in/out robot 51 depicted in FIG. 4, for example. The carrying in/out robot 51 is constituted of: an arm 511 capable of being bent and being raised and lowered; a holding part 512 that is coupled to an end of the arm 511 and sucks and holds a workpiece; and a rotation-driving part 513 that is interposed between the end of the arm 511 and the holding part 512 and rotates the holding part 512 about an axis of rotation in a horizontal direction. The rotation-driving part 513 includes a rotary shaft 513*a* coupled to the holding part and a motor 513*b* that rotates the rotary shaft 513*a*. The raising and lowering and turning of the arm 511, the rotation of the rotary shaft 513*a* by the motor 513*b*, and suction and holding by the holding part 512 are performed under control of the control means 83.

The holding part 512 is adjusted in height to a position slightly lower than a workpiece to be carried out within the loading cassette 411 by raising or lowering the arm 511. The holding part 512 thereafter advances into the loading cassette 411 and holds the workpiece. Then, after the holding part 512 is retracted from the inside of the loading cassette 411, the workpiece is conveyed to the temporary placing means 6 depicted in FIG. 1. The workpiece is positioned in a fixed position in the temporary placing means 6. The workpiece is thereafter conveyed onto one of the chuck tables 21 and 22 that is closer to the temporary placing means 6 by the loading means 52, and is held thereon.

Next, the turn table 23 is rotated, and thereby the workpiece moves to a position below the processing means 3. Then, the spindle 31 depicted in FIG. 2 rotates at a predetermined rotational speed in the processing means 3, and the grinding stone 352 that is rotating is lowered and brought into contact with the workpiece. The workpiece is thereby ground.

The grinding is ended when the workpiece is formed to a predetermined thickness by the grinding. The turn table 23 rotates, and thereby the workpiece after being processed moves to the vicinity of the cleaning means 7. Meanwhile, the rotation of the turn table 23 moves a workpiece before being processed to the position below the processing means 3, and grinding of the grinding stone 352 is started.

The workpiece whose grinding processing is ended and which has moved to the vicinity of the cleaning means 7 is held by the unloading means 53, and conveyed to the cleaning means 7. The cleaning means 7 removes grinding swarf or the like adhering to the workpiece. After an end of the cleaning, the carrying in/out robot 51 houses the workpiece into the unloading cassette 421.

Figure 5:
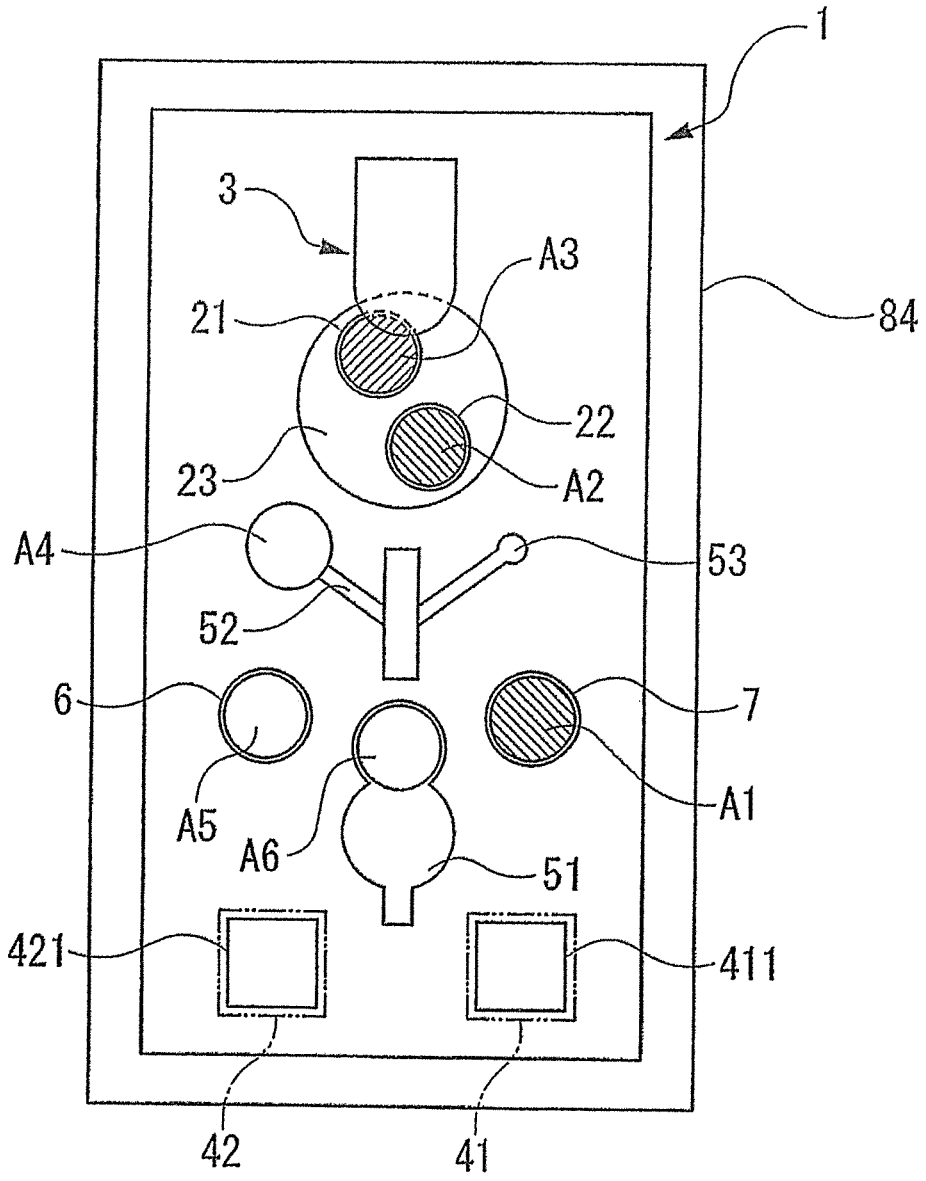
FIG. 5 is a plan view depicting an example of an apparatus general display screen.

Processes in which the processing and the cleaning are performed while the workpieces are thus moved within the apparatus are displayed on the touch panel 8. For example, as depicted in FIG. 5, means such as the chuck tables 21 and 22, the processing means 3, and the like constituting the grinding apparatus 1 are displayed on an apparatus general display screen 84 imitating the whole of the grinding apparatus 1 in the touch panel 8. The apparatus general display screen 84 displays an arrangement plan of each means and workpiece illustrations representing workpieces held by respective means. On the arrangement plan, the means are arranged at positions similar to those in the layout on a real apparatus. In addition, the apparatus general display screen 84 displays all of workpieces moving within the apparatus at present positions. Incidentally, the means displayed on the apparatus general display screen 84 of FIG. 5 are identified by the same reference signs as the real means depicted in FIG. 1. In addition, on the apparatus general display screen 84, different reference signs are given to the respective workpieces.

The control means 83 gives a reference sign to each workpiece according to the height of the holding part 512 when the carrying in/out robot 51 depicted in FIG. 4 carries out the workpiece from the loading cassette 411. For example, when a workpiece in a lowermost stage is carried out, the control means 83 recognizes that the holding part 512 is at a lowermost position, and gives the carried-out workpiece a reference sign of A1 according to the height position of the holding part 512. In addition, reference signs of A2, A3, . . . are given in order as the stage is changed upward one by one. The reference signs are displayed on the apparatus general display screen 84.

For example, a workpiece A1 is located on the cleaning means 7 after being subjected to grinding processing by the processing means 3. In addition, a workpiece A2 is held by the chuck table 22, and is immediately after completing being processed by the processing means 3. A workpiece A3 is held by the chuck table 21, and is being processed by the processing means 3. A workpiece A4 is in a process of being conveyed to the chuck table 22 while held by the loading means 52 after being positioned by the temporary placing means 6. A workpiece A5 is in a state of being placed on the temporary placing means 6. A workpiece A6 is in a state of being held by the carrying in/out robot 51 after being carried out from the loading cassette 411.

The first distinguishing display means 831 displays the workpiece A3 held on the chuck table 21 and being processed by the processing means 3 in a color different from that of the other workpieces (the workpiece A3 is indicated by hatching in FIG. 5) on the apparatus general display screen 84 depicted in FIG. 5. This means that an abnormality has occurred in the workpiece A3 because some abnormality, for example an abnormality in the load current value of the spindle 31 or the like has occurred in the processing means 3. Hence, an operator can easily grasp to which workpiece the error is caused.

On the other hand, the grinding of the workpieces A1 and A2 is ended normally, and therefore the second distinguishing display means 832 displays the workpieces A1 and A2 in a color different from that of workpieces in the middle of being processed or before being processed (the workpieces A1 and A2 are indicated by hatching different from that of the workpiece A3 in FIG. 5). Hence, the operator can also easily grasp to which workpieces no error is caused.

The workpieces A4, A5, and A6 are before being subjected to grinding processing. Thus, the third distinguishing display means 833 displays the workpieces A4, A5, and A6 in a color different from that of workpieces in the middle of being processed and after being processed (the workpieces A4, A5, and A6 are indicated without hatching in FIG. 5).

Figure 6:
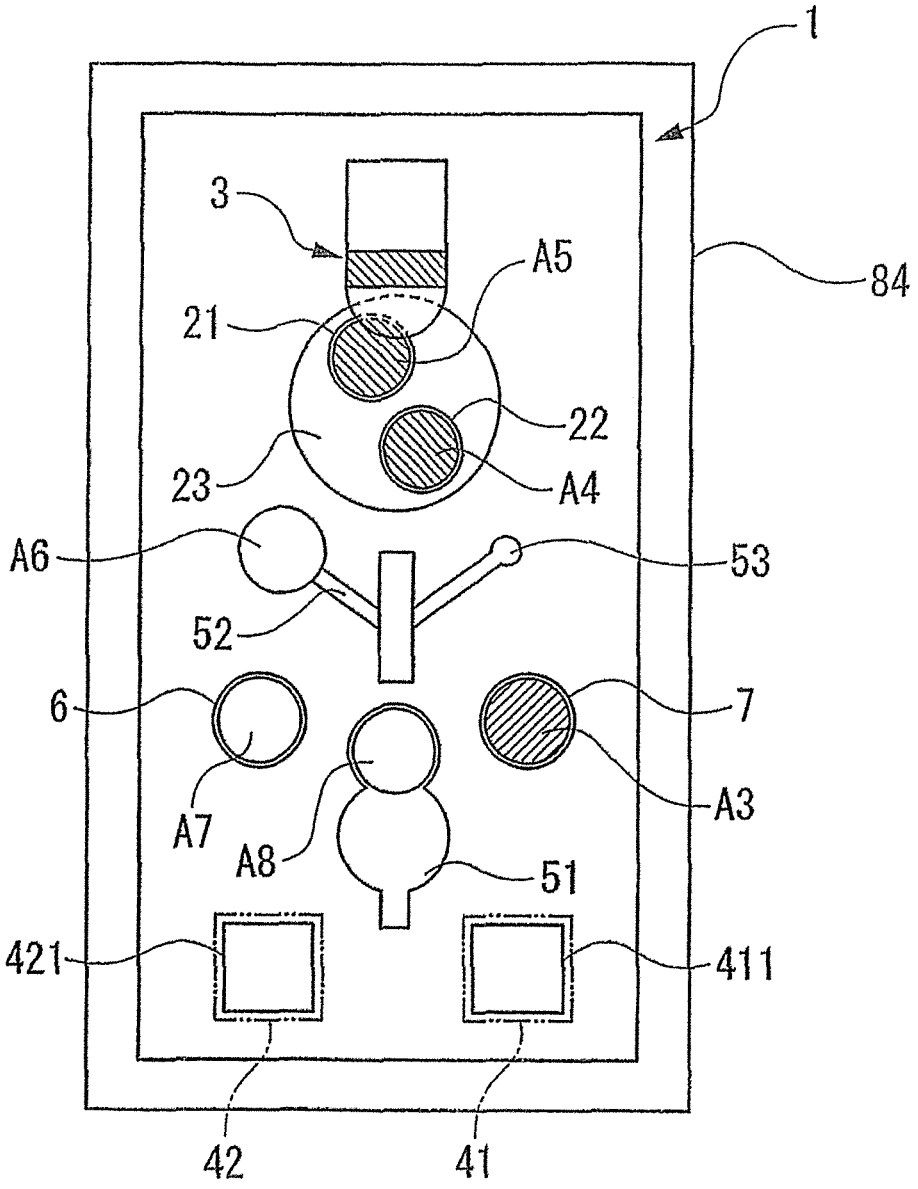
FIG. 6 is a plan view depicting another example of the apparatus general display screen.

As depicted in FIG. 6, the workpiece A3 to which an error is caused in the middle of being processed is displayed in the color indicating the error even after being conveyed to the cleaning means 7. It is therefore possible to grasp to which workpiece the error is caused even after an end of the processing.

In addition, because the processing means 3 causes an abnormality as described above, the fourth distinguishing display means 834 displays the processing means 3 in a color different from that of the other means (the processing means 3 is indicated by hatching in FIG. 6). It is considered that the processing means 3 causes an abnormality due to the grinding of the workpiece A3. When an error thereafter occurs in a plurality of workpieces, it can be determined that there is a problem in the processing means 3. Incidentally, also in a case where the grinding water supplying means 312 depicted in FIG. 2 causes an error, the fourth distinguishing display means 834 displays the processing means 3 in the color different from that of the other means.

Figure 7:
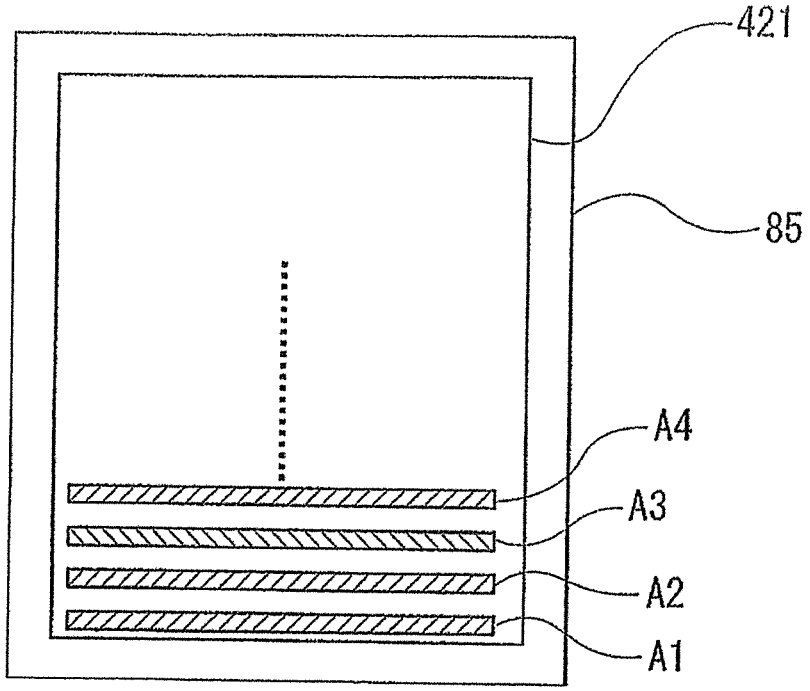
FIG. 7 is a plan view depicting an example of a cassette display screen.

As the processing and the cleaning in the grinding apparatus 1 proceed, workpieces after being processed are sequentially housed into the unloading cassette 421. Here, when the cassette stage 41 on which the loading cassette 411 is mounted or the cassette stage 42 on which the unloading cassette 421 is mounted is touched on the apparatus general display screen 84, workpieces housed in the cassette mounted on the touched cassette stage are displayed in the form of shelves. When the cassette stage 42 is touched, for example, a cassette display screen 85 depicted in FIG. 7 which imitates the unloading cassette 421 is displayed, and workpieces whose processing is ended normally and a workpiece in which an abnormality has occurred are displayed in different colors (with different hatchings in the example depicted in the figure). Because an error is caused at the workpiece A3 on the apparatus general display screen 84 of FIG. 5 and FIG. 6, error display of workpiece A3 is made also on the cassette display screen 85 of FIG. 7. Hence, the workpiece to which the error is caused and the workpieces whose processing is ended normally can be recognized so as to be distinguished from each other even after being housed in the unloading cassette 421.

Figure 8:
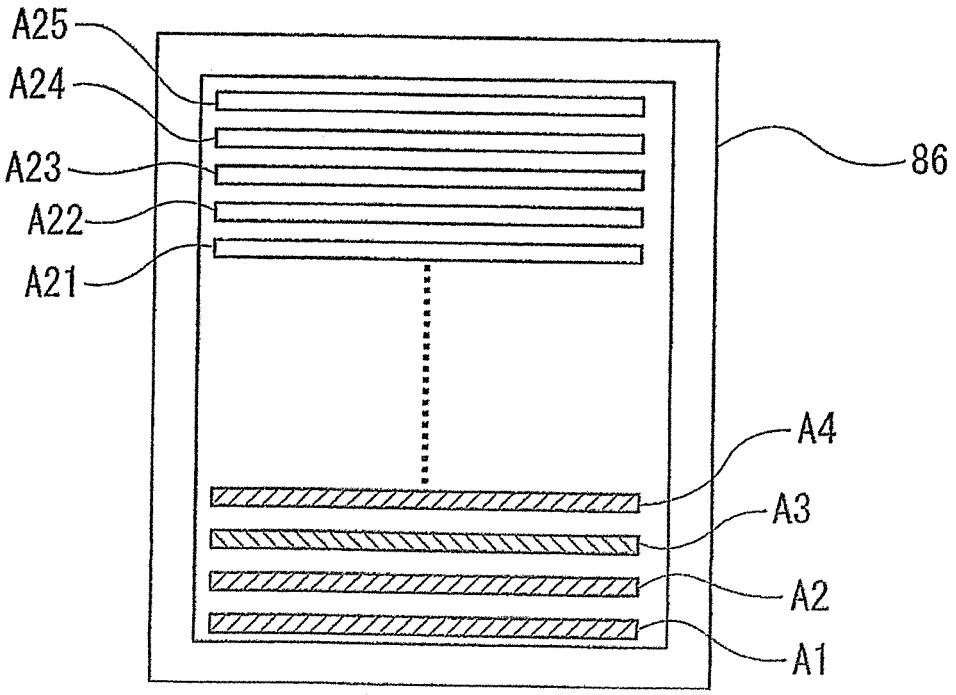
FIG. 8 is a plan view depicting another example of the cassette display screen.

Incidentally, in a case where there is no distinction between a loading cassette and an unloading cassette as cassettes and workpieces before being processed and workpieces after being processed are housed in one cassette, as in a case where only one cassette stage is provided to the grinding apparatus, a cassette display screen 86 depicted in FIG. 8, for example, is displayed, and the workpieces within the cassette are all displayed. On the cassette display screen 86, the workpieces before being processed are displayed in a different color so as to be distinguishable from the workpieces after being processed (according to the presence or absence of hatching in the example depicted in the figure). In addition, as for the workpieces after being processed, workpieces whose processing is ended normally and workpieces in which an abnormality has occurred are displayed in different colors (with different hatchings in the example depicted in the figure). Because an error is caused at the workpiece A3 on the apparatus general display screen 84 of FIG. 5 and FIG. 6, error display of the workpiece A3 is made also on the cassette display screen 86 of FIG. 8. Hence, as for the workpieces after being processed, the workpieces to which the error is caused and the workpieces whose processing is ended normally can be recognized so as to be distinguished from each other even after being housed in the cassette.

In a case where an error occurs at a plurality of workpieces though an abnormality occurs in one means, it can be determined that the means in which the abnormality occurs is the cause. Whether a workpiece to which an error is caused is to be treated as a product or to be discarded is determined after processing. Hence, workpieces to be discarded can be recognized easily when the workpieces after being processed which are housed in the cassette are displayed such that the workpieces to which the error is caused are distinguished from normally processed workpieces.

In the foregoing embodiment, the first distinguishing display means 831, the second distinguishing display means 832, the third distinguishing display means 833, and the fourth distinguishing display means 834 display a specific workpiece or means causing an error by, for example, using a different color or the like so that the specific workpiece or means is distinguishable from other workpieces, means, or the like. However, the specific workpiece or means causing the error may, for example, be displayed so as to be distinguished by a method other than using a different color, the method being blinking, changing size, or changing shape. For example, in the case of distinction by blinking, intervals between turn-on and turn-off are changed for workpieces before being processed, workpieces in the middle of being processed, and workpieces after being processed. In addition, in the case of distinction by differences in size, workpieces before being processed are displayed in a smallest size, workpieces in the middle of being processed are displayed in a normal size, and workpieces after being processed are displayed in a largest size, for example.

In addition, these plurality of display methods may be combined with each other. For example, workpieces before being processed are displayed in a smallest size, workpieces in the middle of being processed are displayed in a normal size, and workpieces after being processed are displayed in a largest size, and the outer circumference of a workpiece to which an error is caused is serrated, or the workpiece to which the error is caused is displayed in a red color. In addition, workpieces before being processed, workpieces in the middle of being processed, and workpieces after being processed are displayed in respective different colors, and a wafer to which an error is caused may be blinked.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A processing apparatus comprising:

a chuck table configured to hold a workpiece;

processing means configured to process the workpiece held by the chuck table, a processing tool being fitted to the processing means;

conveying means configured to convey the workpiece;

a touch panel having an input function of inputting a processing condition and a display function of displaying a state of the processing apparatus; and first distinguishing display means, when means making a holding force or a processing force act on the workpiece causes an error, configured to display a workpiece illustration representing the workpiece to which the error is caused and on which the holding force or the processing force acts distinguishably from another workpiece illustration, the display function of the touch panel being a function of displaying an arrangement plan depicting an arrangement of means when the processing apparatus is viewed from above and workpiece illustrations representing workpieces held by the respective means.

2. The processing apparatus according to claim 1, further comprising:

second distinguishing display means configured to display a workpiece illustration representing a workpiece that is held on the chuck table and completes being normally processed by the processing means distinguishably from the workpiece illustration representing the workpiece to which the error is caused.

3. The processing apparatus according to claim 2, further comprising:

a cassette stage on which a cassette housing workpieces in a form of shelves is mounted; and control means configured to display the cassette in the form of the shelves in an enlarged state and distinguishably display workpiece illustrations representing the workpieces housed in the cassette by the first distinguishing display means and the second distinguishing display means when a cassette stage illustration representing the cassette stage is touched on the arrangement plan of the touch panel.

4. The processing apparatus according to claim 3, further comprising:

third distinguishing display means configured to display a workpiece illustration representing a workpiece before being processed by the processing means distinguishably from a workpiece illustration representing a workpiece after being processed, wherein the workpiece illustration representing the workpiece before being processed among the workpieces housed in the cassette is distinguishably displayed by the third distinguishing display means so as to be distinguished from the workpiece after being processed when the cassette stage illustration representing the cassette stage is touched on the arrangement plan of the touch panel.

5. The processing apparatus according to claim 1, further comprising:

fourth distinguishing display means configured to display a means illustration representing the means causing the error distinguishably from another means illustration on the arrangement plan when the means making the holding force or the processing force act on the workpiece causes the error.

6. The processing apparatus according to claim 1, wherein the processing means is configured and arranged to continue to display the workpiece illustration of the workpiece associated with the error in a manner distinguishably from another workpiece illustration even when the workpiece illustration of the workpiece associated with the error is moved to a different location, such that the workpiece associated with the error is shown in the manner distinguishably from another workpiece illustration at the different location.

7. The processing apparatus according to claim 6, wherein a difference in color distinguishes the workpiece illustration of the workpiece associated with the error from another workpiece illustration.

8. The processing apparatus according to claim 6, wherein a difference in shape distinguishes the workpiece illustration of the workpiece associated with the error from another workpiece illustration.

9. The processing apparatus according to claim 6, wherein a difference in size distinguishes the workpiece illustration of the workpiece associated with the error from another workpiece illustration.

10. The processing apparatus according to claim 6, wherein blinking distinguishes the workpiece illustration of the workpiece associated with the error from another workpiece illustration.

11. The processing apparatus according to claim 1, wherein a difference in color distinguishes the workpiece illustration of the workpiece associated with the error from another workpiece illustration.

12. The processing apparatus according to claim 1, wherein a difference in shape distinguishes the workpiece illustration of the workpiece associated with the error from another workpiece illustration.

13. The processing apparatus according to claim 1, wherein a difference in size distinguishes the workpiece illustration of the workpiece associated with the error from another workpiece illustration.

14. The processing apparatus according to claim 1, wherein blinking distinguishes the workpiece illustration of the workpiece associated with the error from another workpiece illustration.

* * * * *